US008371895B1

(12) United States Patent
Lam

(10) Patent No.: US 8,371,895 B1
(45) Date of Patent: Feb. 12, 2013

(54) TOY PLAY SET

(75) Inventor: Peter Ar-Fu Lam, Torrance, CA (US)

(73) Assignee: People Innovate for Economy Foundation, Inc., Alhambra, CA (US)

( * ) Notice: Subject to any disclaimer, the term of this patent is extended or adjusted under 35 U.S.C. 154(b) by 0 days.

(21) Appl. No.: 10/915,772

(22) Filed: Aug. 11, 2004

Related U.S. Application Data

(63) Continuation-in-part of application No. 10/118,706, filed on Apr. 8, 2002.

(51) Int. Cl.
*A63H 33/04* (2006.01)
*A63H 33/38* (2006.01)

(52) U.S. Cl. ..... 446/108; 446/110; 446/147

(58) Field of Classification Search ..... 446/147, 446/108, 109, 110, 487; 434/128, 308, 317, 434/365, 433
See application file for complete search history.

(56) References Cited

U.S. PATENT DOCUMENTS

| | | | | | |
|---|---|---|---|---|---|
| 3,892,408 | A * | 7/1975 | Small et al. | 273/278 |
| 3,945,643 | A * | 3/1976 | Breslow | 273/243 |
| 3,989,251 | A * | 11/1976 | Barlow | 273/239 |
| 4,107,869 | A * | 8/1978 | Abrams | 446/110 |
| 4,753,597 | A * | 6/1988 | Pash et al. | 434/321 |
| 4,883,443 | A * | 11/1989 | Chase | 446/478 |
| 4,941,859 | A * | 7/1990 | Zaruba | 446/476 |
| 5,234,344 | A * | 8/1993 | Lenkoff | 434/84 |
| D381,705 | S * | 7/1997 | Panthofer | D21/506 |
| 6,110,000 | A * | 8/2000 | Ting | 446/302 |
| 6,554,685 | B2 * | 4/2003 | Lish | 446/487 |
| 6,672,929 | B2 * | 1/2004 | Leleu | 446/72 |

* cited by examiner

*Primary Examiner* — Kien Nguyen

(57) ABSTRACT

A toy play set comprising user designed base plate and structure plates, story telling media, a master doll and accessory toy articles is provided for a child to rebuild a toy playing scene after reading a scene base story, and then for the child to build the play set according to his/her imaginative capability. Interactive audio and/or visual responses are provided when a master toy member touches an accessory toy member for providing further fun in playing the custom designed story scene based play set.

49 Claims, 8 Drawing Sheets

Figure 1A
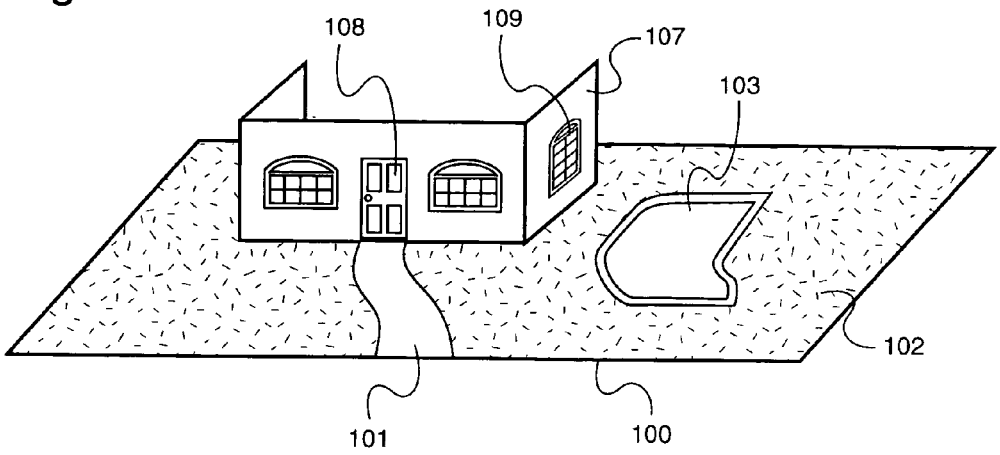
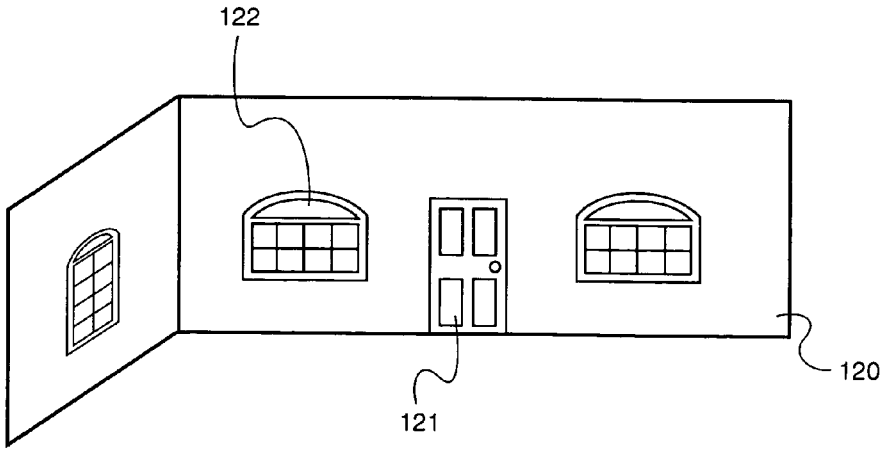
Figure 1B

Figure 2
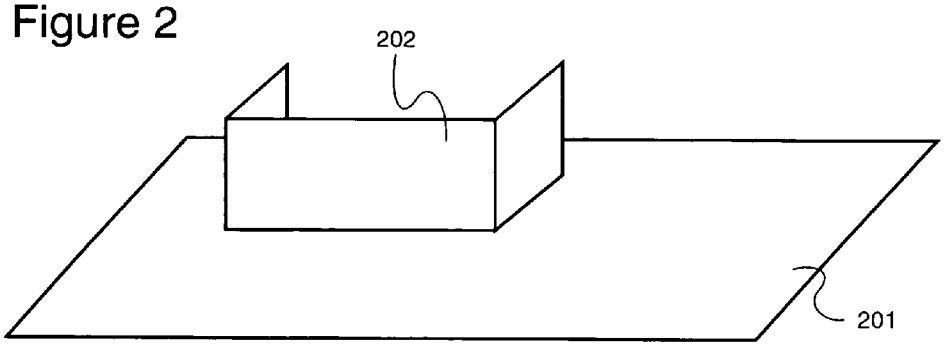
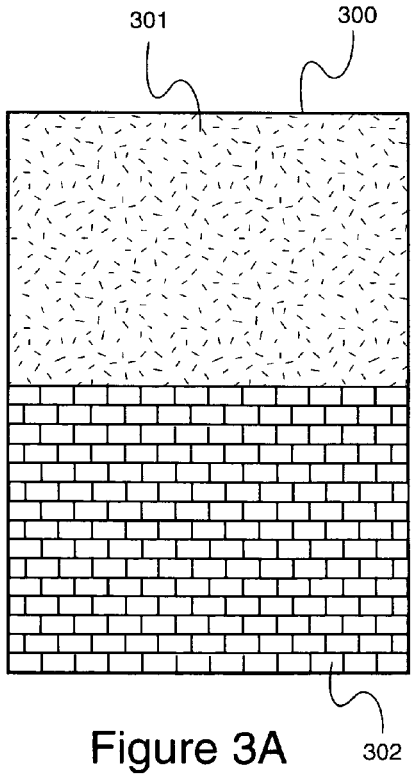
Figure 3A
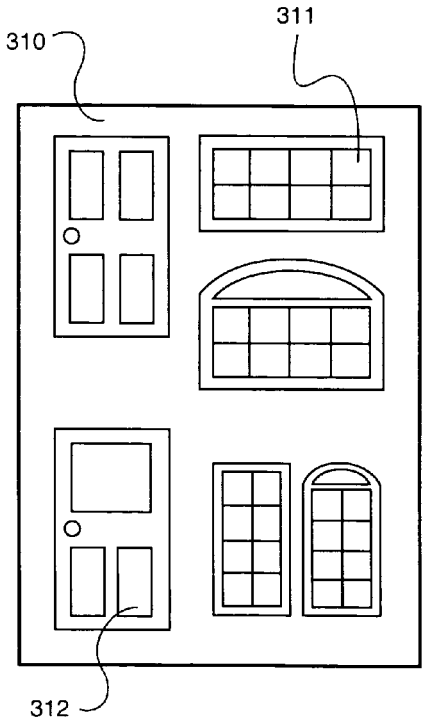
Figure 3B

TOY PLAY SET

This is a Continuation In Part application of pending U.S. patent application Ser. No. 10/118,706 filed Apr. 8, 2002.

FIELD OF THE INVENTION

The present invention relates to an interactive toy play set, particularly a personalized toy play set that enables a child to design the play set according to his/her imagination. The present invention is also related to a method to market a toy play set supported with a story.

BACKGROUND OF THE INVENTION

Traditional toy play set provides a doll and a set of accessory toys for a children to play with the doll. A decorated toy building structure such as a doll house may also be provided to form the play set. This decorated toy structure may rest on a supporting base plate. Since the toy building structure or the base plate is decorated in the factory according to the professional skill of a toy designer, it gives very little room for children to develop imaginative power to design, build the play set and play with the toys. According to an intense research for this invention to study child play pattern, it was discovered that most children establish one or more toy playing scenes after studying a story. The toy playing scenes developed actually varies from child to child, according to their different personalities and intelligence. If a play set is provided according to the toy playing scene envisioned by the child, and suitable accessory toy members related to the major scenes of the story are provided, the child will spent long time to play with the play set, trying to replicate the story captured, and to further develop the story. The story acts as a trigger source or catalyst stimulating a child to participate inside a story scene related game play. The scene of a story when related to game play is defined by the background, timing, set up, characters, dressing, event flowing and other factors related to the story. For example, a game play scene of the Snow White story is related to the characters of Snow White, the prince, the queen and the seven dwarves. The story scene when reflected in child game play is also related to the supporting articles such as the magic mirror, the house of the dwarves and the clothing style of the characters. The difficulty to provide a play set according to this research study are in two areas. Firstly the imaginative toy playing scene developed by every child is different, therefore a common play set cannot be mass produced economically. Special scene building procedures are defined according to the research of this invention. The second difficulty is about cost. Typical toy play set, such as doll houses are relatively large and therefore quite expensive as compared with the smaller accessory toys designed according to the story scene. It is the objective of this invention to provide a toy kit that allows the children to design their own toy play sets according to the toy playing scene they envisioned. It is another objective of this invention to provide a low cost solution enable a child to design and build a toy play set with an affordable toy kit. This toy kit helps children to develop their imagination and design capabilities. It also forms a driving factor to help selling the toy kit to the parents who pay attention to child brain and mental developments. Another objective of this invention is to train a child to decorate a toy play set within a budget, a skill to manage and utilize numbers.

It is also the objective of this invention to provide a method for a toy company to provide story scene based toy kits, which allow children to design their own play set according to their imaginative power after receiving a story from a book, an audio media or from a visual media. Decorative covering designs in line with the story scene, represented by the background, characters and flow of the story are provided, helping a child to design and build a good looking story scene based play set.

Traditional electronics toys draw power from the batteries installed inside the toy. The number of batteries required depends on the working voltage specified by the circuit utilized. For many electronics circuits, three batteries are needed to provide a typical working voltage between 3V to 4.5V. The working voltage required by many microcontroller chips is in between 3V to 6V. In order to provide a reasonable working battery life to a device drawing a current over 100 mA, such as the products that comprise a light bulb, motor or speaker, the size of the batteries selected are typically of AA, C or D size batteries. These batteries not only add considerable weight to the toy, more important they limit the ability of the designer to shrink the size of the toy, a feature that is highly desirable for miniature accessory toy to be used in a toy play set. It is also the objective of this invention to provide a toy play set comprises of miniature electronics accessory toys which do not require internal power resource such as batteries or capacitors of ultra high capacity in order to provide light, sound or motion effects.

SUMMARY OF THE INVENTION

The present invention is firstly directed to a story scene driven toy play set, which allows a child to rebuild the toy playing scene established in the mind after reading a story. Supporting components are then provided for the child to build a toy play set that is in line with the toy playing scene already established inside the mind of the child. Accessory toys in line with the scene of the story are then provided for the child to play with the custom designed play set. Interactive visual and/or audio responses are also provided to enhance the excitement of the toy playing pattern.

In a first embodiment, a base plate and one or more structural plates are provided for a child to build a play set, such as a doll house. The base plate forms the ground plane of the play set. The structural plates form the walls of the doll house. Various covering designs of internal and external floor coverings are provided. Internal floor coverings may include but not limited to tile, wood floor and carpet. External floor coverings may include but not limited to grass land, cement floor, tile floor or even a swimming pool. When decorating the structural wall plates, different wall coverings such as brick walls, wood walls, wall papers, painted wall, textured walls, stucco walls and tiles are provided in the form of covering sheets, or labels. Doors and windows can be applied at different locations of the basic supporting wall plates according to the floor plan designed by the child. Different designs of doors and windows are provided, enabling the child to build a doll house with unique personality. For the first step, the child feels the fun to select the proper wall coverings, door designs and window designs before a play set, such as a doll house is built. Among the different type of door or window covering designs provided, usually only one type of door or window design will be selected. If a door is required to be opened, some work to cut the basic wall plates will be required, or the door is to be assembled in the factory. The floor and wall coverings are usually provided in a bigger dimension than required, therefore the child is required to measure, structure and cut the covering according to the perfect dimension required by the play set. This procedure further trains the child to plan, measure and trim the floor or wall coverings for a perfect fitting. Wall coverings and floor coverings may be provided on separated sheets or combined to form a large single sheet depends on the size of the label sheet. Although most covering designs are provided with two dimensional label sheets, three dimensional covering designs may also be provided in luxury play sets, which offers better margin to the manufacturer. Three dimensional window frame, or door frame designs are mostly provided by injection molding or vacuum forming. Base plates can also be formed by vacuum forming to provide three dimensional effects. Injection molding provide better structural detail than vacuum molding but it provides only single color parts. An economical way to provide multiple colors three dimensional covering designs is to mold the parts with clear, transparent and colorless material. Color printed pictures of the covering designs are then provided beneath the clear molded components. For cost saving purpose, some three dimensional accessory toy may also be provided in the form of a two dimension printing. In a different embodiment, the windows labels are replaced by window coverings, such as drapery, curtain, shutter or blind.

In addition to the floor and wall coverings, the play set is supported with two or three dimensional accessory toy members, such as interior furniture, garden furniture, appliances, pets and even friends of a master doll. Each of these accessory toy member may be included an electronics circuit which will define or control the generation of visual, audio or motion effects when power is provided to turn on the electronics circuits. The master doll or a master toy member may be provided with a power source such as batteries for providing power to the accessory toy member through two or more metal contacts. The master doll can also be equipped with a speaker that provides audio responses when the contacts of the master doll is connected with the electronics circuits of an accessory toy member. Since the master toy member, or the master doll is designed to work with many different accessory toy members, placing the battery and speaker inside the master toy member significantly reduces the overall systems cost because the great number of accessory toys is not required to provide speaker circuit or battery power. The size requirement of the accessory toys, usually smaller than the master toy member can also be reduced.

In another preferred embodiment, a toy play set is provided in the form of a kit comprising a basic base plate, one or more basic structural plates, a story telling media helping the child to build a play set scene in the mind. Covering sheets printed with different groups of covering designs are provided for the child to shop, and select the covering designs to build his/her dream play set. Story telling media can be represented by printed media like story books, comic books. It can also be represented by audio media like cassette tapes or CD ROM. It may be provided in the form of visual media such as DVD or VCR tapes. In a special marketing arrangement, the story telling media is released earlier than the launch of the play set and accessory toy members. This will give the toy company a chance to test the popularity of the story scene before substantial investment into the design, tooling, inventory, promotion of the play set and accessory toys is committed. Since a reputable toy character may be used to form different scene base stories, different play set designs and accessory toy members can be provided to support successive launch of different stories composed with the same toy character. For example, a popular girl's doll character can become a main character in a 15th century fairy story. She may also become the main character in a 21st century space exploration story. The different scenes of different stories provide different representation of a main character doll. The representation of a doll according to a story scene is defined by the personality, shape, look, hair style and dressing preference etc. The different $15^{th}$ and $21^{st}$ century story scenes offered different business opportunities to the toy company. Once the play set concept is proven to be accepted by the field, a toy company is able to launch dolls, play sets and accessories at regular intervals according to different story scenes. This business model is therefore be able to provide consistent income to a toy company.

In another preferred embodiment, the groups of covering designs are stored in a mass storage media, such as CD ROM, hard drive inside a computer, or even stored at a remote web site. Accordingly the child is able to shop for his/her preferred floor coverings, wall coverings or accessories with the support of a computer. This procedure gives the child an experience of shopping to remodel a home. In another game type embodiment, the child is given a budget to build a play set and each printed covering design or accessory toy member is provide with a price tag. The child is provided an account having an amount of money to spent for remodeling the home. Accordingly the child is trained how to manage budget for a home remodeling project.

Scene building procedures are defined according to this research that helps a toy company to plant toy playing scenes after reading, listening or viewing the story telling media. A business model is also developed for a toy company to work with a publishing company and implement these defined scene building procedure to promote play set play pattern that helps to develop the imaginative minds of children.

The novel features of the invention are set forth with particularity in the appended claims. The invention will best be understood from the following description, when read in conjunction with the accompanying drawings.

DESCRIPTION OF THE DRAWINGS

FIG. 1A illustrates a toy play set having a base plate and a set of structure plates that forms a building;

FIG. 1B illustrates the internal decoration of the building structure;

FIG. 2 illustrated the basic structure plate and the basic base plate without any decorative design;

FIG. 3A is a covering sheet or label sheet, which provides different designs of ground coverings for a child to decorate the base plate;

FIG. 3B is a covering sheet or label sheet, which provides different designs of doors and windows for a child to decorate the structure plates;

DETAILED DESCRIPTION

Figure 4A:
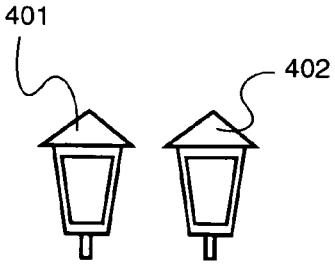
FIG. 4A are three dimensional design of accessory toys provided to decorate the structure plates.

Attention is initially directed to FIG. 1A, which depicts a toy play set comprising a base plate 100 and structure plates 107. Although the base plate of FIG. 1A represents a ground plane, other embodiments of the base plate in different shape formed by injection molding, extrusions, stamping or vacuum forming is also possible. On top of the base plate 102, and exterior to the structural building 107 is a user designed front and back yard. Most of the yard is covered by grass land 102. In front of the door is a concrete covering 101. By the side of the yard is a swimming pool 103. The exterior walls of the structural plates 107 are decorated with illustrated designs of door and windows 108, 107. FIG. 1B illustrates the interior design of the structural plates 120. The interior wall can be decorated with labels providing different kinds of wall coverings according to the design selection of the user. Doors and windows 121, 122 are provided on top of the wall covering to completed the custom play set design.

Attention is now directed to FIG. 2, which illustrates the basic base plate 201 and basic structural plate 202 before decorative covering designs are applied. Basic plate is a plate defined to be free of any decoration or simply decorated with a very basic pattern or texture. The structural plate 202 is positioned perpendicular to the base plate 201 to simulate the walls of a building, while the base plate simulates the floor plane of said building. FIG. 3A illustrated a cover sheet designed in the form of a printed label 300 that provides the grass land 301 and brick wall pattern 302. Depends on the size of the label, one or more decorative patterns can be included on a label. A user, typically the child who play with the toy play set, may cut the printed label according to a play set designed by him/her. Typical labels provided for decorating a basic base plate comprising different designs of floor coverings. Floor covering designs may include but not limited to different designs of tile, wood floor, carpet, grass land, flowers, and even a pool. FIG. 3B illustrated a cover sheet or printed label 310 that provides different covering designs in the shape of doors and/or windows. All the door designs presented on a covering sheet is defined as a door related group of covering designs. Accordingly all the window designs printed on the label sheet 310 forms a second windows related group of covering designs. A user may select one of the windows or doors and apply it to the structural plate 202 of FIG. 2 to design a toy play set. It should be noted that different styles of doors or windows are usually provided; therefore only one type of door or windows may be selected according to the design imagination capability and preference of the user. In the cover sheet example of FIG. 3B, a group of window design and another group of door designs are provided. For the exemplary group of door designs, two (n=2) door designs 310, 312 are provided. The user may select one or more of the door designs to design and decorate the plate 202. In the example of FIG. 1B, one (m=1) door design 121 or 310 was selected by the user. Because the goal of the play set is to stimulate design capability of a child, therefore it is up to the child to determine where to position the doors and the windows. It should be noted that different children usually provide play sets of completely different designs. Although the covering sheet 300 is provided for floor covering and the covering sheet 311 is provided for wall covering, the two sheets can be combined into a single bigger sheet when larger size printing paper is more economical.

Figure 4C:
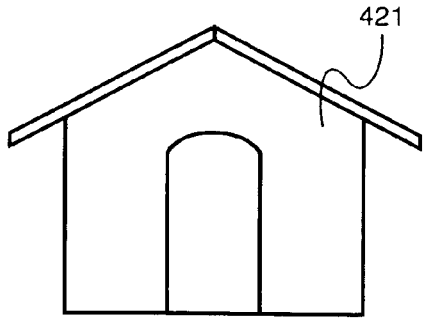
FIG. 4C is a two dimensional pet house provided to decorate the toy play set.
Figure 4B:
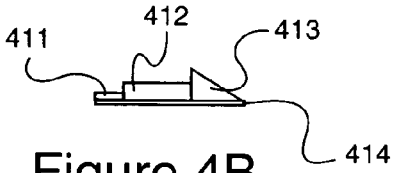
FIG. 4B illustrated the side view of the accessory toys of FIG. 4A.
Figure 5A:
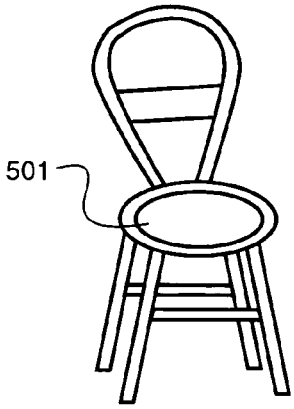
FIG. 5A is an example of a three dimensional interior toy accessory.
Figure 5B:
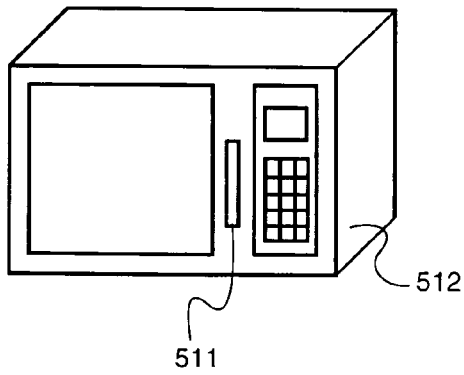
FIG. 5B is another example of a three dimensional interior toy accessory that comprises contact terminals provided to make electrical contact with a doll.
Figure 8A:
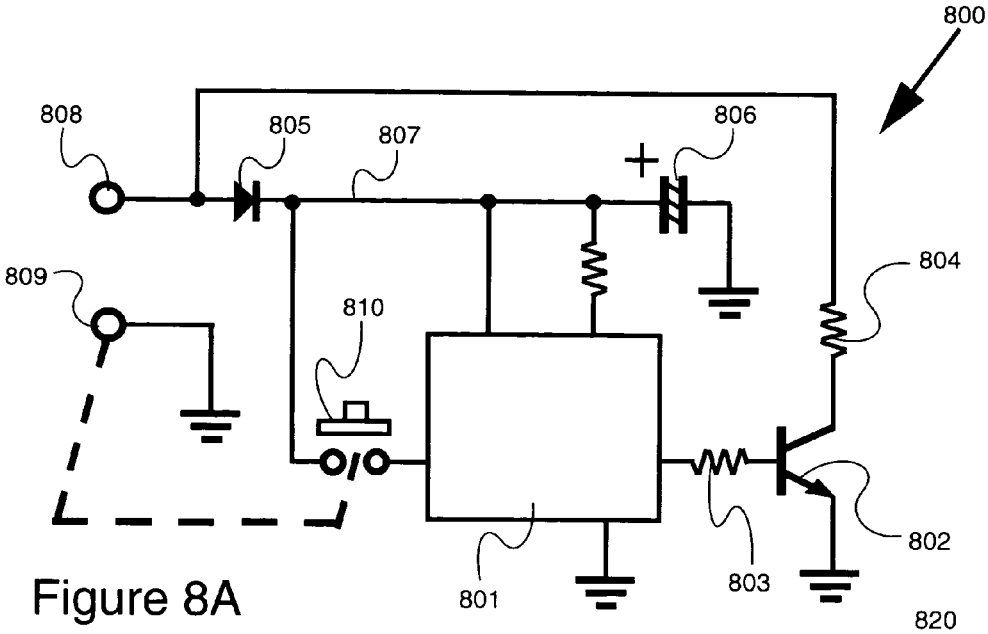
FIG. 8A is an embodiment of an electronics circuit built inside an accessory toy provided to be contacted by the mating contact terminals of a doll, in order to generate light, sound or motion effects.
Figure 8B:
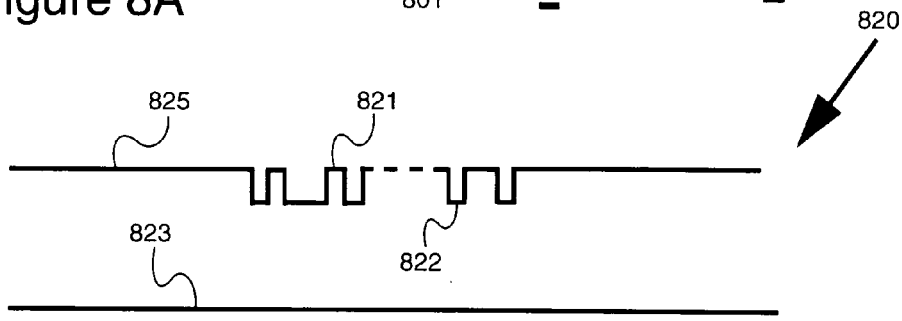
FIG. 8B is the waveform of the electrical current flowing through the contact terminals and the electronics circuit of FIG. 8A.
Figure 8C:
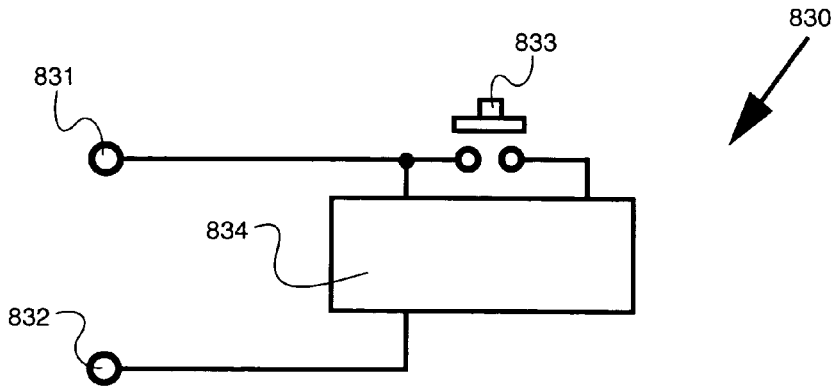
FIG. 8C is another electronics circuit built inside the accessory toy that provides a button for controlling the response of the accessory toy.
Figure 9A:
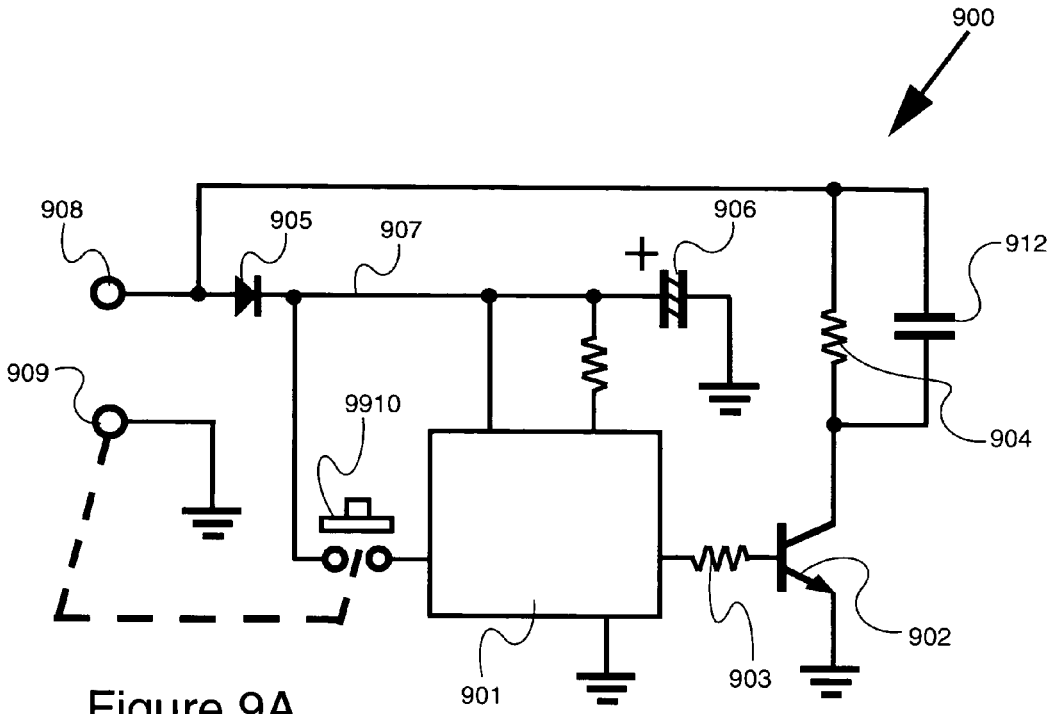
FIG. 9A is an example of a sound generating electronics circuit built inside an accessory toy.
Figure 9B:
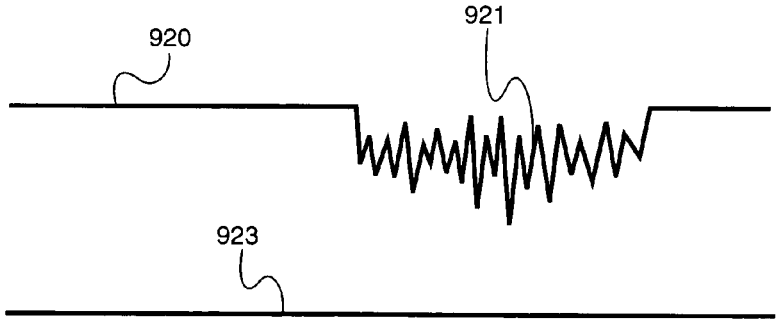
FIG. 9B is the waveform of the electrical current flowing through the contact terminals and the electronics circuit of FIG. 9A.
Figure 10:
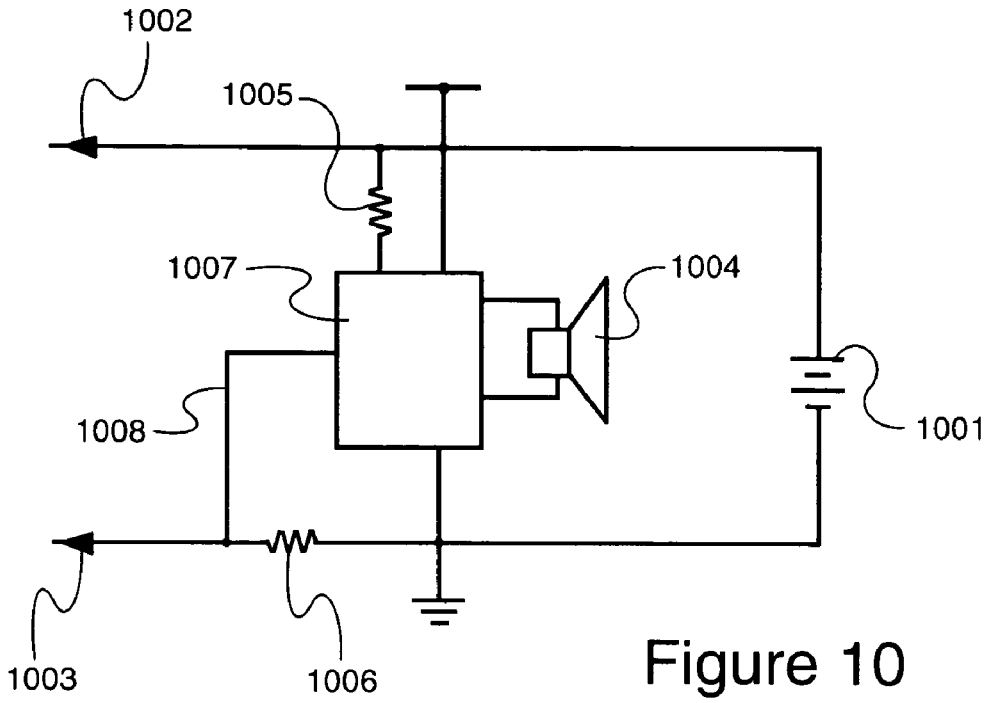
FIG. 10 illustrates an integrated circuit designed for a doll, that is configured to derive pulsing signals from the power line making contact with an accessory toy and to drive a speaker in both directions.
Figure 11A:
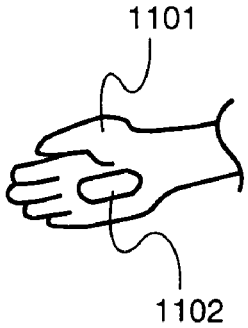
FIG. 11A illustrates the palm side of a doll's hand for touching and powering an accessory toy member.
Figure 11B:
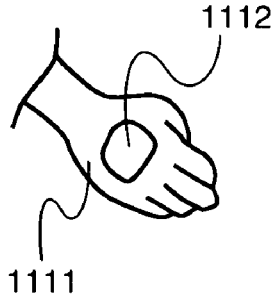
FIG. 11B illustrates the rear side of the doll's hand of FIG. 11A.

FIG. 4A illustrates a pair of external door lights 401 and 402, which represent an example of accessory decorative toy members. These door lights may be printed as two dimensional label sheets. It may also be provided in a three dimensional shape according to different type of molding or forming processes. FIG. 4B illustrates the side view of three dimensional door lamps. The three dimensional portions 411 to 413 of the door lamp may be formed by a molding process. The door lamp may be positioned on label sheet 414. In another embodiment, the three-dimensional portion of the accessory toy member 411 to 413 are formed with transparent plastic. Details of the door lamp may be printed on the label 414. While most two dimensional accessory toy articles such as doors or windows can be provide in a three dimension way, three dimensional objects can also be represented by a two dimensional label to be added to the play set. FIG. 4C is a two dimensional label of a pet house to be positioned against the structural plates 202 of FIG. 2. FIG. 5A represents another three dimensional accessory toy member, a chair to be positioned inside the doll house formed by the structural walls or structural plates 202. FIG. 5B is another accessory toy member formed in the shape of an appliance. The microwave oven 512 may comprise a microcontroller that defines or control the light or sound when the microwave oven is activated. It should be noted that in order to minimize the actual dimension of the accessory toy member, the microwave 512 may not have size to accommodate any battery or speaker. The slot 511 is provided for the microwave oven 512 to receive power and provide control/audio signals when it is in contact with the hand of a doll. Attention is now directed to the electronics circuit 800 as shown in FIG. 8A. When external power is applied to the contact terminals 808 and 809, the microcontroller 801 is powered up and provided control or data signals to drive the transistor 802 through the resistor 803. The switching control or data signal, is fed back to the power lines through the resistor 804. A diode 805 is provided to protect the microcontroller 801 to be damaged by any reverse polarity supply voltage sent to the contact terminals 808 and 809. The microcontroller 801 of FIG. 8A can also be programmed to turn on and off a motor or a light generating component, such as a LED. FIG. 8B illustrates the waveform of the power line 808 referenced from the ground point 809. The voltage level 823 is the reference ground level. The voltage level 825 represents the supplying voltage that powers up the microcontroller 801. The high and low level digital signals 821 and 822 may represent the control signals or data signals to be sent to an external circuit through the power line. One or more push button 810 is provide to control the different working modes of the microcontroller 801. FIG. 8C illustrates another embodiment 830 having a special designed IC 834 to represent the circuit 800 of FIG. 8A. FIG. 9A illustrates another preferred embodiment which provides an analog signal instead of the digital signal of FIG. 8A. This analog signal is fed to the power line through the resistor 904 and the capacitor 912. FIG. 9B illustrates the power supply waveform of FIG. 9A. The DC components voltage is represented by the DC level 920. When an analog signal is generated, the analog signal 921 is superimposed on the DC power line, ready to be picked up by an external circuit for driving a sound transducer such as a speaker. FIG. 10 illustrated the electronics circuit to be included inside a master toy member, such as a master doll, that is also a key member of the play set. This circuit supplies power voltage to the microcontroller of the accessory toy circuit of FIGS. 8A and 9A. A speaker 1004 and a power source represented by the batteries 1001 are provided inside the torso of the doll. The battery 1001 provides power to external circuit through the contacts 1002 and 1003. When the contacts 1002 and 1003 are in touch with the electronics circuit of an accessory toy, the power provided by the master doll powers up the microcontroller positioned inside the accessory toy. The digital or analog signal transmitted by the accessory toy member is then received by the control circuit illustrated in FIG. 10. This signal is fed to the microcontroller 1007 through the current path 1008. Driving signals can also be provided by the microcontroller 1007 for producing a light, sound or motion effects. The electronics circuit for a microcontroller to drive a LED, light bulb or motor is well known to any person skill in the art and therefore not to be repeated here. FIG. 11A illustrates an embodiment having the contact 1002 of FIG. 10 wired to the palm 1101 of the doll and connected with the contact plate 1102. The other terminal may be provided on the same side or opposite side of the palm as illustrated in FIG. 11B. The doll hand of FIGS. 11A and 11B can then be inserted into the slot 511 to activate the microwave oven 512 illustrated in FIG. 5B. It should be noted that the contact points of a doll can also be provided at other convenient locations of the doll, such as the feet for interfacing with an accessory toy member. According to this design, the speaker and battery of the play set is provided inside the larger size doll. The size of all the accessory toy members can be minimized to provide only a small internal IC chip and two contact points. Another advantage is for the toy supplier to add unlimited accessory toy members to the play set at a later time because all the control or data information are stored inside each accessory toy member. Although accessory toys are represented by passive articles such as a microwave oven in the illustrated examples, it is alleged that accessory toy can also be presented into the form of other dolls. When the master doll shake hand with an accessory doll, audio phrases about the individual accessory doll will be generated.

Figure 6A:
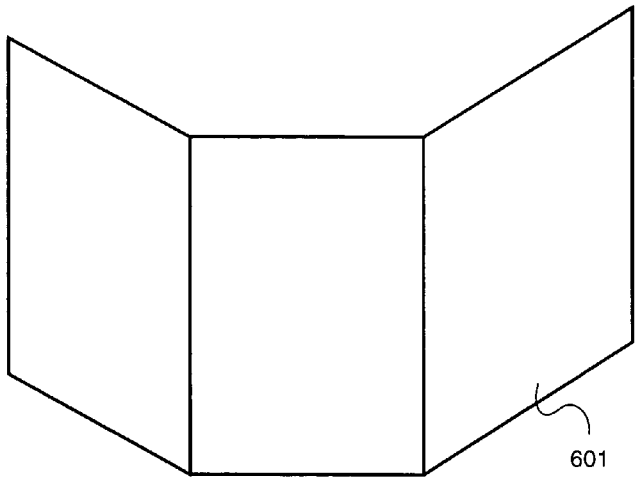
FIGS. 6A and 6B illustrates the vertical structural plates and a set of labels provided to decorate the vertical structural plates.
Figure 6B:
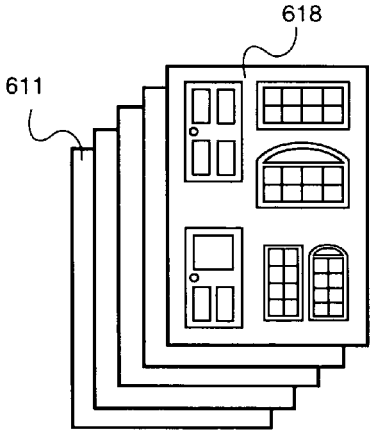
Figure 6C:
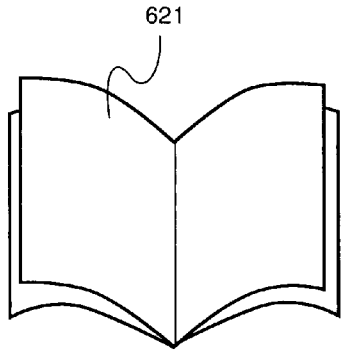
FIG. 6C illustrates a story telling media in the form of a book.
Figure 6D:
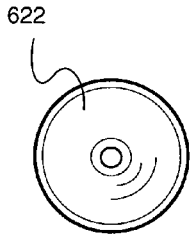
FIG. 6D illustrates a story telling media in the form of a CD or DVD.
Figure 6E:
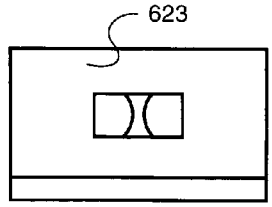
FIG. 6E illustrates a story telling media in the form of a video or audio cassette tape.

Attention is now drawn to FIGS. 6A to 6E, which illustrates different components to be packed into a retail package for building a toy play set. The base or structural plates 601, the decoration labels 611 to 618 and one of the story telling media 621 to 623 are packed together to form a toy play set building kit. The story telling media forms an important part of the story scene base play set. A story with impressive scenes builds one or more pictures inside the mind of a child. The play set components of FIGS. 6A, 6B and other story scene based accessory toy components enable children to build different toy play sets according to their imaginative capability. Children has more motive to play with the play set because firstly they have built a picture of the toy playing scene after reading the story. Secondly, it is a play set that is designed by themselves, according to the playing scene they envisioned in the mind. The parents have greater desire to purchase the toy play set because it helps to develop the imaginative capability of the children. The toy manufacturers are usually able to provide different stories having different scenes about a reputable toy character. As a result different play sets can be provided for the same toy character to work with different story scenes and also different environments, such as fairy tells or graduation parties. It means the toy manufacturers are able to launch successive play sets driven by different story scenes, applied to a reputable toy character and launch the play set under different time frames. Each scene base story may be supported with different story characters or articles, which provides opportunity for toy companies to introduce additional toy characters or accessory articles to the product line. When there are many story telling media and related play set building kits available in the market, the story telling media is preferable to be packaged with the other play set components to form a retail kit so as to avoid confusion in the stores. Typical story telling media are represented by the book as shown in FIG. 6C, CD or DVD as shown in FIG. 6D and audio or video tape as shown in FIG. 6E. In order to help building quality toy playing scenes suitable for reputable toy characters, it is preferable for a toy company to identify a professional publishing company to provide quality stories to be presented in a story telling media. It is also preferable for the selected publishing company to implement special scene building procedures that helps a child to build a toy playing scene in the mind after reading, listening or viewing the story. A lot of research had been conducted according to the inventive steps of this invention to define the effective scene building procedure. Scene building procedure for printed media, such as books comprises the following steps:

(a) Define one or more toy playing scenes. The number of toy playing scenes is preferred to be less than three so as not to distract the concentration of the children reading the book.

(b) Intentionally compose the story such that the key events are conducted in the defined toy playing scenes.

(c) Provide more detail descriptions to make the toy playing scene stand out.

(d) Provide graphic presentation of the toy playing scene for a written story.

(e) Provide enlarged, possibly double pages, or center fold illustration of the toy playing scene in case of a comic book.

Scene building procedure for audio media is subtler. It is define by any of the following steps:

(a) Define one or more toy playing scenes. The number of toy playing scenes is preferred to be less than three so as not to distract the children away from the toy playing scenes to be built.

(b) Intentionally compose the story such that the key events are conducted in the toy playing scenes defined.

(c) Provide more detail descriptions to make the toy playing scene stand out.

(d) Provide illustration of the toy playing scene on the packaging of the audio media.

(e) Provide additional booklet or poster with the packaging to illustrate the defined toy playing scene.

Scene building procedure for video media comprises the following steps:

(a) Define one or more toy playing scenes. The number of toy playing scenes is preferred to be less than three so as not to distract the children away from the toy playing scenes to be built.

(b) Intentionally compose the story such that the key events are conducted in the toy playing scenes defined.

(c) Provide more detail descriptions to make the toy playing scene stand out.

(d) Provide significantly more exposure time for the defined toy playing scene than any other scene.

(e) Provide illustration of the toy playing scene on the packaging of the video media.

(f) Provide additional booklet or poster with the packaging to illustrate the defined toy playing scene.

Figure 7:
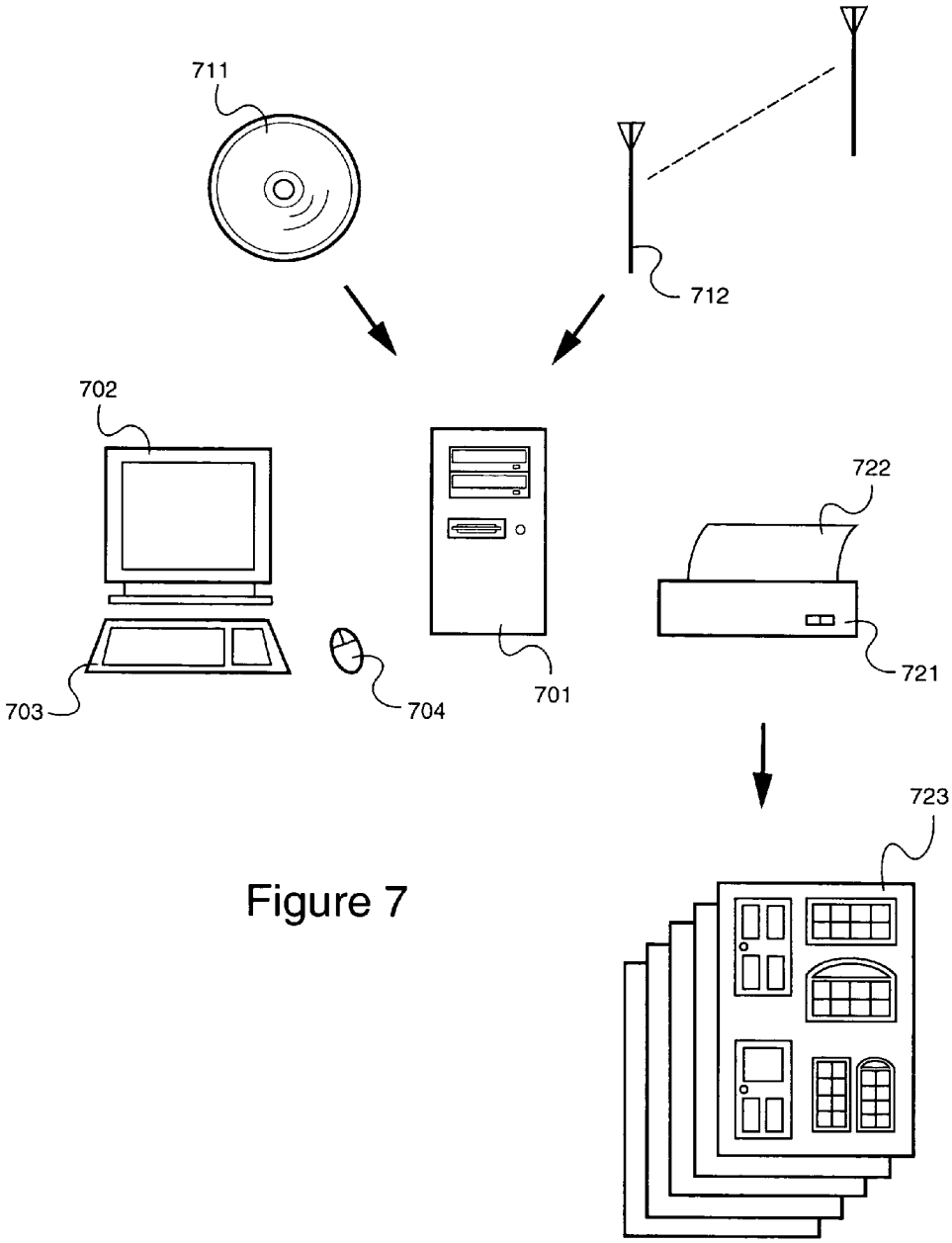
FIG. 7 illustrates a system that allows a child to select and print decorative covering designs provided by a CD ROM, a computer or from a remote site.

Although decorative cover sheets are provided as labels under the previous discussed embodiments, different two dimensional covering designs can be obtained from a CD ROM, a computer, or even from an internet web site as illustrated in FIG. 7. The children may view pictures of the decoration or covering designs with the computer monitor 702. Library of covering designs are stored inside the CD ROM 711, the computer 701 or from a remote web site connected through the communication line 712. Selected designs 723 are printed by the color printer 721. As a summary, children simply shop the design materials from the CD ROM, computer or internet web site, select the desired covering designs or decorative items and print it by a color printer.

It should also be noted that the story telling media may be packed with the play set design supporting components to form a play set building kit. In some other situation, the story telling media may be launched earlier to test market acceptance before substantial investment is provided to market the story scene based play set.

Instead of a doll play set for girls, this invention is also applicable for the boys toy play set. For example, a boy may build a micro city play set having vehicles, buildings and other structures. Accordingly, the definition of doll in this specification is not limited to dolls for girls; doll is defined as a toy representation of any figure, including but not limited to male figures, female figures, action figures and cartoon figures. Since most children will be able to envision several scenes after reading a story, it is also a desire for a toy company to study the story launched, possibly conducting a survey and predict the most impressive scenes of the story, so as to provide decorative covering designs to furnish the base or structural plates for rebuilding these most impressive scenes with the toy kit provided. Accessory toy members presented in these most impressive scenes are also to be provided to further support the game play. Furthermore, the story telling media is also preferable to be packed with a related toy play set to form a retail package to form a complete toy play set package helping to develop the imaginative mind of a child.

A significant characteristic of the toy play set is that some accessory toy member is designed to provide only an audio response while another accessory toy member is characterized by providing only a visual response. It is also possible for another accessory toy member to provide both kinds of responses. The personality of each accessory toy member is defined by it's unique shape or the unique response provided. The master toy member is therefore required to provide a structure and/or interfacing circuit suitable for initiating both kinds of responses.

From the foregoing, it should now be appreciated that the applicant has disclosed herein embodiments of a custom design toy play set enabling children to replicate events happened in the story or to further develop the story according to the imaginative capability of the children. It should also be noted that there are different methods provided to help a child to build a personalized play set according to the scenes of a story. Although detailed embodiments of the invention have been disclosed, it is recognized that variations and modifications, all within the spirit of the invention, will occur to those skilled in the art. It is accordingly intended that all such variations and modifications be encompassed by the appended claims.

I claim:

1. A toy play set retail package comprising:

a story telling media that tells a specific story printed or stored in said story telling media;

wherein said story defines a first story scene; said toy play set further comprising a master doll representing a character of said story; and at least a first accessory toy member designed according to the content of said story;

wherein said master doll and said first accessory toy members are configured for a child to replicate said first story scene after a child received said specific story.

2. The toy play set retail package of claim 1 further comprises:

a base plate;

one or more structural plates;

first cover sheet printed with first group of covering designs provided for decorating said base plate; and second cover sheet printed with second group of covering designs provided for decorating said structural plates; wherein at least one of said covering designs is related to said first story scene.

3. The toy play set retail package of claim 2 wherein said first and second cover sheets are part of a larger cover sheet.

4. The toy play set retail package of claim 2 wherein the covering designs of said first or second cover sheet is selected and printed by an user according to the designs provided by a CD ROM, a computer or from a remote web site.

5. The toy play set retail package of claim 1 wherein said story is presented by a visual media, a book, a DVD, a VCR tape; an audio media in the form of an audio cassette tape, or a CD; a printed media, a magnetic media or an optical media.

6. The toy play set retail package of claim 1 wherein said first accessory toy members is provided an electronics circuit configured to define or control light, motion or sound effect and said master doll is provided with at least two contacts, a sound transducer, and a power source; wherein said master doll and said first accessory toy member are configured to provide at least a light, sound or motion effect when the contacts of said doll are in contact with said first accessory toy member.

7. The toy play set retail package of claim 6 wherein said first accessory toy member is a second doll.

8. A toy play set provided in the form of a retail package comprising at least the following components:

a basic base plate;

one or more basic structural plates; and first cover sheet separated from said basic plate or basic structural plate;

wherein said first cover sheet is printed with first group of n covering designs configured for a user to select m covering designs for decorating said basic base plate or said basic structural plate according to the imaginative power of the user; wherein said first cover sheet is further structured for said m covering designs to over cover a surface of said basic base plate or any of said basic structural plates; and wherein n is an integer equal or larger than m.

9. The toy play set of claim 8 wherein said first cover sheet is printed with first group of covering designs provided for decorating said basic base plate; said toy play set further comprises a second cover sheet printed with second group of covering designs provided for decorating said basic structural plate.

10. The toy play set of claim 8 wherein said first cover sheet comprises multiple images of at least one of the following articles:

(1) grass land;
(2) floor coverings;
(3) pool;
(4) flowers:
(5) two dimensional illustrations; and
(6) three dimensional accessories.

11. The toy play set of claim 8 wherein said second cover sheet comprises multiple images of at least one of the following articles:

(1) windows;
(2) window coverings;
(3) doors;
(4) wall coverings;
(5) lamps;
(6) two dimensional illustrations; and
(7) three dimensional accessories.

12. The toy play set of claim 8 wherein said first or second cover sheet comprises printed image of an article positioned beneath a transparent three dimensional molded structure.

13. The toy play set of claim 8 further comprising a three dimensional accessory toy provided in the shape of one of the following articles:

(1) furniture;
(2) appliance;
(3) lamp
(4) pet;
(5) vehicles;
(6) pet house;
(7) garden hose; and
(8) gate.

14. The toy play set of claim 8 further comprising a story telling media to tell a story that defines a first story scene.

15. The toy play set of claim 14 wherein said story telling media is represented by a visual media, a book, a DVD, a VCR tape; an audio media in the form of an audio cassette tape, or a CD; a printed media, a magnetic media or an optical media.

16. The toy play set of claim 14 wherein said first or second cover sheets are provided with at least one covering design related to said first story scene.

17. The toy play set of claim 14 wherein said toy play set further comprising a three dimensional toy article or a dolt related to said first story scene.

18. The toy play set of claim 8 wherein said play set is further provided with one or more accessory toys each having an electronics circuit configured to define or control a light, motion or sound effect and said doll is provided with at least two contacts, a sound transducer, and a power source; wherein said doll and said accessory toy are configured to provide at least a light, sound or motion effect when the contacts of said doll are in contact with said accessory toy.

19. The toy play set of claim 18 wherein one of said accessory toys is a second doll.

20. A method to provide a toy play set for supporting a play pattern; said method comprises a first step of:

(a) providing a story; and enabling a child to imagine and design a first story scene after receiving said story; said method further comprises the steps of:
(b) providing a basic base plate;
(c) providing one or more basic structural plates;
(d) providing a first cover sheet printed with first group of covering designs suitable for decorating said basic base plate; and
(e) providing a second cover sheet printed with second group of covering designs suitable for decorating said basic structural plate; wherein at least one of said covering designs is related to said first story scene.

21. The method to provide a toy play set of claim 20 wherein said first and second cover sheets are part of a larger cover sheet.

22. The method to provide a toy play set of claim 20 wherein said story is presented by a printed media, a magnetic media or an optical media.

23. The method to provide a toy play set of claim 20 further comprising a step to provide a doll representing a character of said story.

24. The method to provide a toy play set of claim 23 further comprising a step to provide one or more accessory toys, each having an electronics circuit configured to define or control a light, motion or sound effect and said doll is provided with at least two contacts, a sound transducer, and a power source;

wherein said doll and said accessory toys are configured to provide at least a light, sound or motion effect when the contacts of said doll are in contact with one of said accessory toys.

25. The method to provide a toy play set of claim 20 further comprising a step for a child to rebuild said first story scene with said basic base plate, basic structural plate and said first and second cover sheets provided.

26. The method to provide a toy play set of claim 20 comprising a further step to provide a system enabling a user to select and print the covering designs of said first or second cover sheet according to the designs provided by a CR ROM, a computer or from a remote web site.

27. The method to provide a toy play set of claim 20 further comprising a step to include scene building procedure in preparing the story of step (a).

28. The method to provide a toy play set of claim 20 further comprising a step to plan for the story scene of said toy play set when composing or preparing the story of step (a).

29. The method to provide a toy play set of claim 28 further comprising a step to enhance the presentation the story scene of said toy play set when composing or preparing the story of step (a).

30. A method to provide a toy play set structured for a child to imagine and design a toy playing scene; said method comprises the steps of:

(a) providing a basic base plate;
(b) providing one or more basic structural plates;
(c) providing a first cover sheet printed with first group of covering designs suitable for the child to selectively cover and decorate said basic base plate; and
(d) providing a second cover sheet printed with second group of covering designs suitable for the child to selectively cover and decorate said basic structural plate.

31. The method to provide a toy play set of claim 30 wherein said first and second cover sheets are part of a larger cover sheet.

32. The method to provide a toy play set of claim 30 wherein said first cover sheet comprises multiple images of at least one of the following articles:

(1) grass land;
(2) floor coverings;
(3) pool;
(4) flowers;
(5) two dimensional illustrations; and
(6) three dimensional accessories.

33. The method to provide a toy play set of claim 30 wherein said second cover sheet comprises multiple images of at least one of the following articles:

(1) windows;
(2) window coverings;
(3) doors;
(4) wall coverings;
(5) lamps;
(6) two dimensional illustrations; and
(7) three dimensional accessories.

34. The method to provide a toy play set of claim 30 further comprising a step to provide a transparent three dimensional molded structure positioned on top of a covering design of said first or second cover sheet.

35. The method to provide a toy play set of claim 30 further comprising a step to provide a three dimensional accessory item configured in the shape of one of the following articles:

(1) furniture;
(2) appliance;
(3) lamp
(4) pet;
(5) vehicles;
(6) pet house;
(7) garden hose; and
(8) gate.

36. The method to provide a toy play set of claim 30 further comprising a step to provide a story that defines a first story scene.

37. The method to provide a toy play set of claim 36 wherein said story is presented by a book, a CD, a DVD or a tape cassette.

38. The method to provide a toy play set of claim 36 wherein said first or second cover sheets are provided with at least one covering design designed to fit with said first story scene.

39. The method to provide a toy play set of claim 36 wherein said method further comprises a three dimensional toy article or a doll related to said first story scene.

40. The method to provide a toy play set of claim 27 further comprising the steps of:

(e) providing one or more accessory toys each having an electronics circuit configured to define or control a light, motion or sound effect;
(f) providing a doll with at least two contacts, a sound transducer, and a power source; wherein said doll and said accessory toys are configured to provide at least a light, sound or motion effect when the contacts of said doll are in contact with one of said accessory toys.

41. The method to provide a toy play set of claim 40 wherein said accessory toy is a second doll.

42. A method to provide a toy play set structured for a child to imagine and design a toy playing scene; said method comprises the steps of:

(a) providing a toy structure to a child;
(b) providing a series of optional covering designs, or accessory toy members for the selection of a child to furnish said toy structure; wherein said covering designs are structured for the child to cover said accessory toy member or said toy structure; and each of said optional design coverings or accessory toy members is given a price tag;
(c) providing the child a budget or a specific amount of simulated money to select and purchase a collection of optional covering designs or accessory toy members for decorating said basic toy structure.

43. The method to provide a toy play set to a child of claim 42 comprising the further steps of:

(d) providing a first story having a first story scene
(e) designing the optional design covering or accessory toy members of step (b) according to the first story scene of step (d).

44. The method to provide a toy play set to a child of claim 42 comprising the further steps of:

(d) providing a first master toy member and a second accessory toy member
(e) providing an electronics circuit to said second accessory toy member for defining or controlling a light, motion or sound effect; and
(f) providing said first master toy member with at least two contacts, a sound transducer, and a power source wherein said master toy member and said second accessory toy member are configured to provide at least a light, sound or motion effect when the contacts of said master toy member are in contact with said second accessory toy member.

45. A method to provide a toy play set for child playing comprising the steps of:

(a) providing a story that enables a child to imagine and build a first story scene
(b) providing a basic plate;
(c) predicting at least a first and a second story scene derived from said story;
(d) providing a first cover sheet printed with first group of covering designs suitable for decorating said basic toy play set according to said first story scene; and
(e) providing a second cover sheet printed with second group of covering designs suitable for decorating said toy play set according to said second story scene.

46. The method to provide a toy play set for child playing of claim 45 further comprising a step to provide a master toy member and at least one accessory for a child to play with said toy play set simulating said first and second story scenes.

47. The method to provide a toy play set of claim 45 further comprising a step to include scene building procedure in preparing the story of step (a).

48. The method to provide a toy play set of claim 45 further comprising a step to plan for the story scenes of said toy play set when composing or preparing the story of step (a).

49. The method to provide a toy play set of claim 48 further comprising a step to enhance the presentation the story scenes of said toy play set when composing or preparing the story of step (a).

* * * * *